US012024983B2

(12) United States Patent
Albertz et al.

(10) Patent No.: US 12,024,983 B2
(45) Date of Patent: Jul. 2, 2024

(54) METHOD FOR USING $CO_2$ STORAGE IN STRUCTURAL LOWS TO ENHANCE RESERVOIR DRIVE MECHANISMS

(71) Applicant: ARAMCO SERVICES COMPANY, Houston, TX (US)

(72) Inventors: Markus Albertz, The Woodlands, TX (US); Harun Ates, Katy, TX (US); Anuj Gupta, Katy, TX (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/822,343

(22) Filed: Aug. 25, 2022

(65) Prior Publication Data

US 2024/0068331 A1 Feb. 29, 2024

(51) Int. Cl.
*E21B 41/00* (2006.01)
*E21B 43/16* (2006.01)

(52) U.S. Cl.
CPC ..... *E21B 41/0064* (2013.01); *E21B 43/164* (2013.01)

(58) Field of Classification Search
CPC ..... E21B 41/0064; E21B 43/164
See application file for complete search history.

(56) References Cited

U.S. PATENT DOCUMENTS 2,875,833 A 3/1959 Martin
9,187,246 B2 * 11/2015 Høier ..... E21B 41/0064
9,850,421 B2 * 12/2017 Abbas ..... E21B 43/164
(Continued)

FOREIGN PATENT DOCUMENTS

JP 2008082023 A 4/2008

OTHER PUBLICATIONS

Azazi, E. & Cinar, Y. 2013. Approximate Analytical Solutions for CO2 Injectivity Into Saline Formations, Paper SPE 165575. SPE Reservoir Evaluation & Engineering, Society of Petroleum Engineering, 123-133, 11 pages.
(Continued)

*Primary Examiner* — Silvana C Runyan
(74) *Attorney, Agent, or Firm* — Osha Bergman Watanabe & Burton LLP

(57) ABSTRACT

A method and system for both enhancing oil recovery of a reservoir and permanently sequestering carbon dioxide ($CO_2$) is described. The method includes dissolving $CO_2$ in a base fluid at a surface location of an injection formation, forming a dense $CO_2$-brine solution, introducing the dense $CO_2$-brine solution into an injection well, accumulating a volume of the dense $CO_2$-brine solution in a structural low, displacing a native formation fluid from the injection well, increasing a fluid drive pressure from the injection well to a producing well, and displacing hydrocarbons of the producing well. The system includes an injection system in fluid communication with an injection well, a production well of the hydrocarbon production formation, and a dense $CO_2$-brine solution that has a density greater than a native formation fluid of the injection formation.

18 Claims, 4 Drawing Sheets

(56) References Cited

U.S. PATENT DOCUMENTS

| | | | | |
|---|---|---|---|---|
| 2014/0130498 | A1 | 5/2014 | Randolph | |
| 2015/0096755 | A1* | 4/2015 | Martucci | C09K 8/594 166/305.1 |
| 2016/0230062 | A1* | 8/2016 | Beuterbaugh | E21B 43/164 |
| 2022/0019718 | A1* | 1/2022 | AlSaud | E21B 43/164 |

OTHER PUBLICATIONS

Birkholzer, J., Zhou, Q. & Tsang, C. 2009. Large-scale impact of CO2 storage in deep saline aquifers: A sensitivity study on pressure response in stratified systems. International Journal of Greenhouse Gas Control, 3, 181-194, 14 pages.

Buscheck, T. A., White, J. A., Chen, M., Sun, Y., Hao, Y., Aines, R. D., Bourcier, W. L. & Bielicki, J. M. 2014. Pre-injection Brine Production for Managing Pressure in Compartmentalized CO2 Storage Reservoirs. Energy Procedia, 63, 5333-5340, 8 pages.

CMG. 2022. GEM Compositional & Unconventional Simulator [Online]. Computer Modelling Group Ltd. Available: https://www.cmgl.ca/gem [Accessed Jan. 6, 2022], 4 pages.

Friedlingstein, P., et al. 2020. Global Carbon Budget 2020. Earth System Science Data, 12, 3269-3340, 41 pages.

Garcia, S., Kaminska, S. & Mercedes Maroto-Valer, M. 2010. Underground carbon dioxide storage in saline formations. Proceedings of the Institution of Civil Engineers—Waste and Resource Management, 163, 77-88, 12 pages.

Graupner, B. J., Li, D. & Bauer, S. 2011. The coupled simulator ECLIPSE-OpenGeoSys for the simulation of CO2 storage in saline formations. Energy Procedia, 4, 3794-3800, 7pages.

Kelemen, P., Benson, S. M., Pilorgé, H., Psarras, P. & Wilcox, J. 2019. An Overview of the Status and Challenges of CO2 Storage in Minerals and Geological Formations. Frontiers in Climate, 20 pages.

Lackner, K. S., Wendt, C. H., Butt, D., P., Joyce Jr., E., L. & Sharp, D. H. 1995. Carbon Dioxide Disposal in Carbonate Minerals. Energy, 20, 1153-1170, 18 pages.

Liu, S., Sang, S., Ma, J., Wang, X., Du, Y. & Wang, T. 2018. Three-dimensional digitalization modeling characterization of pores in high-rank coal in the southern Qinshui basin. Geosciences Journal, 23, 175-188, 14 pages.

NETL 2010. Carbon Dioxide Enhanced Oil Recovery. U.S. Department of Energy, National Energy Technology Laboratory, 32 pages.

Pruess, K. & Spycher, N. 2007. ECO2N—A fluid property module for the TOUGH2 code for studies of CO2 storage in saline aquifers. Energy Conversion and Management, 48, 1761-1767, 7 pages.

Seifritz, W. 1990. CO2 Disposal by Means of Silicates. Nature, 345, 486, 1 page.

Sigfusson, B., Gislason, S. R., Matter, J. M., Stute, M., Gunnlaugsson, E., Gunnarsson, I., Aradottir, E. S., Sigurdardottir, H., Mesfin, K., Alfredsson, H. A., Wolff-Boenisch, D., Arnarsson, M. T. & Oelkers, E. H. 2015. Solving the carbon-dioxide buoyancy challenge: The design and field testing of a dissolved CO2 injection system. International Journal of Greenhouse Gas Control, 37, 213-219, 18 pages.

Sills, S. R. 1993. Drive Mechanism and Recovery. In: Morton-Thompson, D. & Woods, A. M. (eds.) Development Geology Reference Manual. American Association of Petroleum Geologists, 5 pages.

Ringrose, P. S., et al. 2021. Storage of Carbon Dioxide in Saline Aquifers: Physicochemical Processes, Key Constraints, and Scale-Up Potential. Annu. Rev. Chem. Biomol. Eng., 12, 471-494, 27 pages.

Zhou, Q., Birkholzer, J. T., Mehnert, E., Lin, Y. F. & Zhang, K. 2010. Modeling basin- and plume-scale processes of CO2 storage for full-scale deployment. Ground Water, 48, 494-514, 21 pages.

Kou, Z., Wang, T., Chen, Z., and Jiang, J. 2021. A fast and reliable methodology to evaluate maximum CO2 storage capacity of depleted coal seams: A case study. Energy, 231, 16 pages.

Stirling, E. J., Fugelli, E. M. G. & Thompson, M. 2018. The edges of the wedges: a systematic approach to trap definition and risking for stratigraphic, combination and sub-unconformity traps. In: Bowman, M. & Levell, B. (eds.) Petroleum Geology of NW Europe: 50 Years of Learning - Proceedings of the 8th Petroleum Geology Conference. London: Geological Society, 14 pages.

Snæbjörnsdóttir, S. Ó., Sigfússon, B., Marieni, C., Goldberg, D., Gislason, S. R. & Oelkers, E. H. 2020. Carbon dioxide storage through mineral carbonation. Nature Reviews Earth & Environment, 1, 90-102, 13 pages.

Dake, L. P. 1978. Fundamentals of Reservoir Engineering, The Netherlands, Elsevier Science Publishers, Preface, 8 pages.

IPCC 2021. Climate Change 2021: The Physical Science Basis. Contribution of Working Group I to the Sixth Assessment Report of the Intergovernmental Panel on Climate Change, V. Masson-Delmotte et al., Preface, 12 pages.

* cited by examiner

METHOD FOR USING $CO_2$ STORAGE IN STRUCTURAL LOWS TO ENHANCE RESERVOIR DRIVE MECHANISMS

BACKGROUND

It is now widely accepted that anthropogenic carbon dioxide ($CO_2$) emissions tend to throw the natural carbon cycle out of balance, where $CO_2$ resulting from all natural and anthropogenic carbon sources are taken up by $CO_2$ sinks. As a consequence, a significant fraction of the $CO_2$ that is emitted on an annual basis tends to reside in the atmosphere.

Despite the emerging widespread and very significant efforts to reduce $CO_2$ emissions worldwide as well as efforts to transition from fossil fuels to clean and renewable energies, petroleum production will likely continue in the foreseeable future to meet the world's growing energy demand, leading to continuing $CO_2$ emissions. Therefore, there has been interest in $CO_2$ storage in order to remove the $CO_2$ from the atmosphere.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a method for both enhancing oil recovery of a reservoir and permanently sequestering carbon dioxide ($CO_2$). The method includes dissolving $CO_2$ in a base fluid at a surface location of an injection formation, thereby forming a dense $CO_2$-brine solution, introducing the dense $CO_2$-brine solution into an injection well having an injection point proximate to the structural low, thereby accumulating a volume of the dense $CO_2$-brine solution in the structural low, displacing a native formation fluid from the injection well, thereby increasing a fluid drive pressure from the injection well to a producing well having a receiving end proximate to the structural high via the hydraulic connection, and displacing hydrocarbons of the producing well.

The dense $CO_2$-brine solution of the method for both enhancing oil recovery of a reservoir and permanently sequestering carbon dioxide ($CO_2$) has a density greater than a native formation fluid of the injection formation. The injection formation is the same geologic formation or a different geologic formation a hydrocarbon bearing formation. The injection formation includes a structural low, and the hydrocarbon bearing formation includes a structural high. The structural low is in fluid communication with the structural high via a hydraulic connection.

In another aspect, embodiments herein relate to a system for both enhancing oil recovery of a reservoir and permanently sequestering $CO_2$. The system includes an injection system in fluid communication with an injection well having an injection point proximate to a structural low in an injection formation in fluid communication with a hydrocarbon production formation via a hydraulic connection. A production well is disposed with a receiving end proximate to a structural high of the hydrocarbon production formation, and the injection formation and the hydrocarbon product formation are the same geologic formation or different geologic formations. The system also includes a dense $CO_2$-brine solution that has a density greater than a native formation fluid of the injection formation.

Other aspects and advantages of the claimed subject matter will be apparent from the following description and the appended claims.

DETAILED DESCRIPTION

The present methods and systems provide $CO_2$ storage in geological formations while simultaneously enhancing the efficiency of petroleum recovery from the subsurface.

Embodiments of the present disclosure includes processes directed to methods and systems for both the sequestration of $CO_2$ in a manner that supports a hydrocarbon-bearing reservoir production energy. In one or more embodiments, the buoyancy of $CO_2$ that can be problematically associated with conventional $CO_2$ injection is eliminated such that a dense $CO_2$-brine solution is provided and pressure buildup that can be associated with conventional $CO_2$ storage is reduced. The term "dense" or "density" as used throughout may refer to the weight of a solution at a surface or a subsurface location of a formation.

Figure 1:
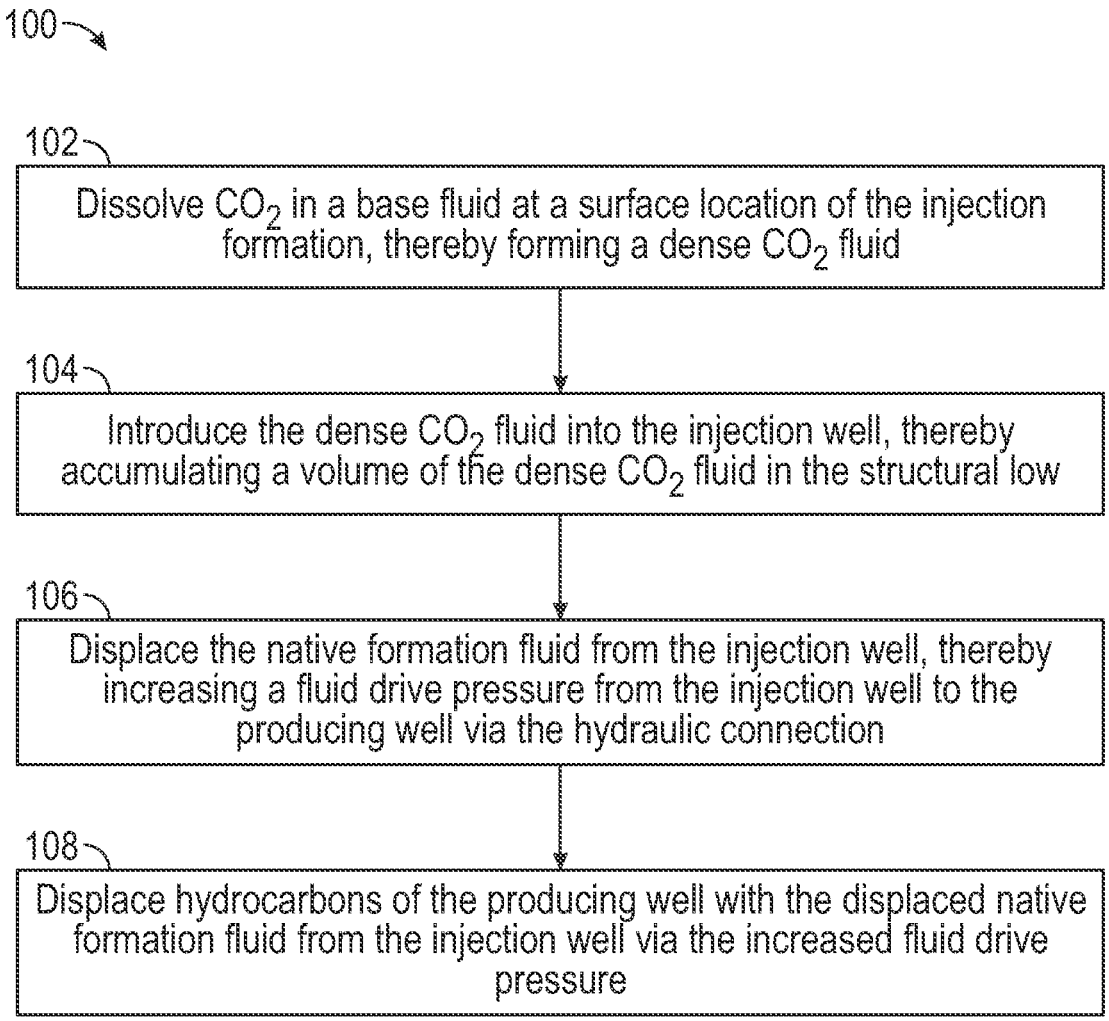
FIG. 1 is a flow diagram of a method for both the sequestration of $CO_2$ and hydrocarbon production in accordance with one or more embodiments.

FIG. 1 is a flow diagram of a method 100 for both the sequestration of $CO_2$ and hydrocarbon production in accordance with one or more embodiments. A method of one or more embodiments enhances oil recovery of a reservoir and permanently sequesters $CO_2$. In one or more embodiments, the method includes block 102 of dissolving $CO_2$ in a base fluid at a surface location of the injection formation to form a dense $CO_2$-brine solution. Block 104 includes introducing the dense $CO_2$-brine solution into the injection well, thereby accumulating a volume of the dense $CO_2$-brine solution in the structural low. In one or more embodiments, the dense $CO_2$-brine solution accumulates in the structural low during or after injection via an injection well. In block 106, the native formation fluid may be displaced from the injection well, thereby increasing a fluid drive pressure from the injection well to the producing well via the hydraulic connection. In block 108, hydrocarbons of the producing well may be displaced with the displaced native formation fluid from the injection well via the increased fluid drive pressure.

The dense $CO_2$-brine solution injection point of the injection formation may be proximate to a structural low. In one or more particular embodiments, the dense $CO_2$-brine solution injection point is in a structural low. As mentioned above, the formation may include a structural low in fluid communication with a structural high. In one or more embodiments, the fluid communication is a hydraulic connection. The hydrocarbon bearing formation may include the structural high. The hydrocarbon bearing formation and the injection formation may be located in the same geologic formation or in different geologic formations. In one or more embodiments, a structural low is in fluid communication with a structural high via different geologic formations. A non-limiting example of a different geologic formation may include a fault juxtaposition. In one or more embodiments, the injection formation and the hydrocarbon bearing formation are an aquifer-reservoir pair.

The injection formation of one or more embodiments may include a saline formation (or an "aquifer"). Aquifers may include any sedimentary layers with brines containing high concentrations of dissolved salts, making them unsuitable for use as drinking water sources as the average amount of total dissolved solids in aquifers exceeds about 10,000 mg/L (milligrams per Liter). Embodiments in which the dense $CO_2$-brine solution injection point is an aquifer, the aquifer may have a depth of at least about 800 m (meters). In one or more embodiments, the depth of at least about 800 m of the aquifer relates to a maximum storage capacity of $CO_2$ via injection of a dense $CO_2$-brine solution.

In one or more embodiments, a deep saline aquifer with a structural low is selected as dense $CO_2$-brine solution injection site a sequestration sites due to large collective capacity, high formation pressure, favorable geochemistry, or combinations thereof. The large collective capacities of deep saline aquifers may relate to the storage of about 100 to 10,000 Gt (Gigatonnes) of $CO_2$. In addition, a deep saline aquifer may be selected due to a proximity to producing sources worldwide.

In one or more embodiments, selecting the injection formation and hydrocarbon bearing formation includes analyzing seismic interpretation, well log analysis, production history, or combinations thereof. A computer system may analyze the seismic interpretation, well log analysis, production history, or combinations thereof. In such embodiments, a computer system may obtain seismic data regarding a geological region of interest. The computer system may deconvolute the obtained seismic data, well-log data, production data, regarding the geological region of interest. The computer system may then transmit the geologic region comprising the injection formation hydraulically connected to a hydrocarbon-bearing formation The injection formation, the hydrocarbon bearing formation, or both may be characterized according to methods commonly known in the art. Formation parameters, such as maximum depth, formation pressure, formation temperature, formation composition, or combinations thereof may be characterized to select the injection site.

In one or more embodiments, selecting the injection formation and hydrocarbon bearing formation includes determining a density of a native formation fluid. The native formation fluid may include a native formation water, such as a brine, from the injection formation. Determining the composition of core samples of the injection formation and/or the hydrocarbon bearing formation, the composition of fluid samples of the injection formation and/or the hydrocarbon bearing formation and measuring the density of the native formation fluid may be performed via standard sampling and testing procedures.

The selection of the hydraulically connected injection formation and hydrocarbon bearing formation, such as a hydrocarbon bearing reservoir, may include identifying geologic trap configurations. In one or more embodiments, the selection of the hydraulically connected injection formation and hydrocarbon bearing formation may include determining if the geologic trap configuration is surrounded by impermeable rocks. Such determination may be made via characterization of formation parameters as described above.

The selection of a geologic trap configuration may include selection of a stratigraphic trap configuration. Non-limiting examples of geographic formations of one or more embodiments are displayed in FIGS. 2 and 3. The schematics of FIGS. 3 and 4 depicts a single hydrocarbon bearing formation in fluid communication with an injection formation.

Figure 2:
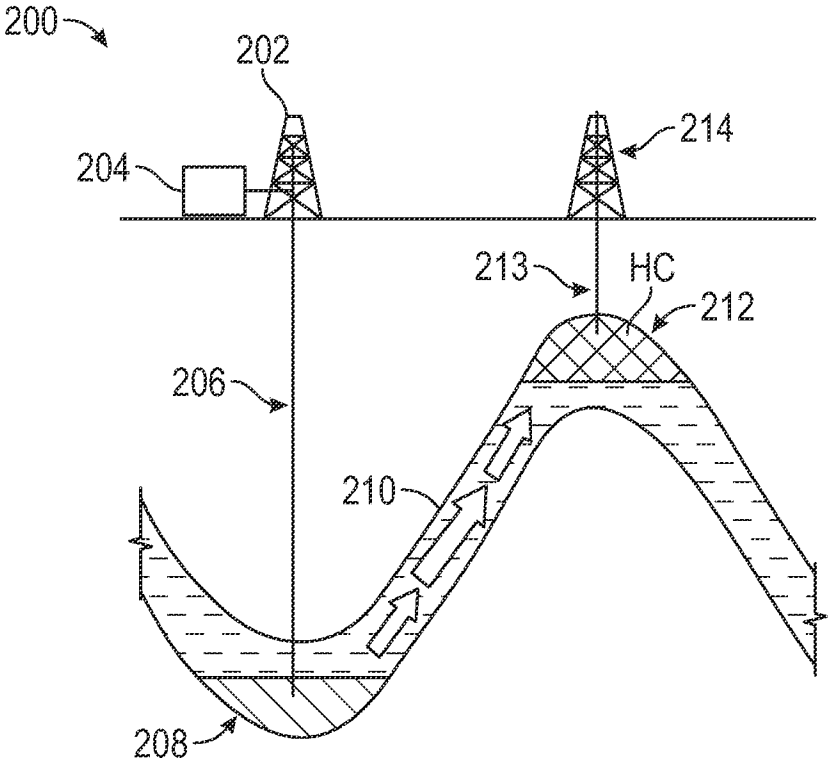
FIG. 2 is a schematic of a syncline-anticline pair that are in fluid communication via hydraulic connection in the same geologic formation in accordance with one or more embodiments.

FIG. 2 is a schematic of a syncline-anticline pair 200 that are in fluid communication via hydraulic connection 210. Synclines include a structural low 208 in folded regions that may be paired with an anticline as a structural high 212 that include hydrocarbons (HC). In one or more embodiments, the same geologic formation selected for a method of both sequestration of $CO_2$ and production of hydrocarbons has suitable porosity and permeability. In one or more embodiments, the injection formation 202 is an aquifer. The injection formation 202 may include an injection system 204 at a surface site of the injection formation. As described below, the injection system 204 may be in fluid communication with an injection well 206. In such configurations, an injection well 206 and a producing well 213 of a hydrocarbon bearing formation 214 may be independently disposed in the injection formation and hydrocarbon bearing formation, respectively.

Figure 3:
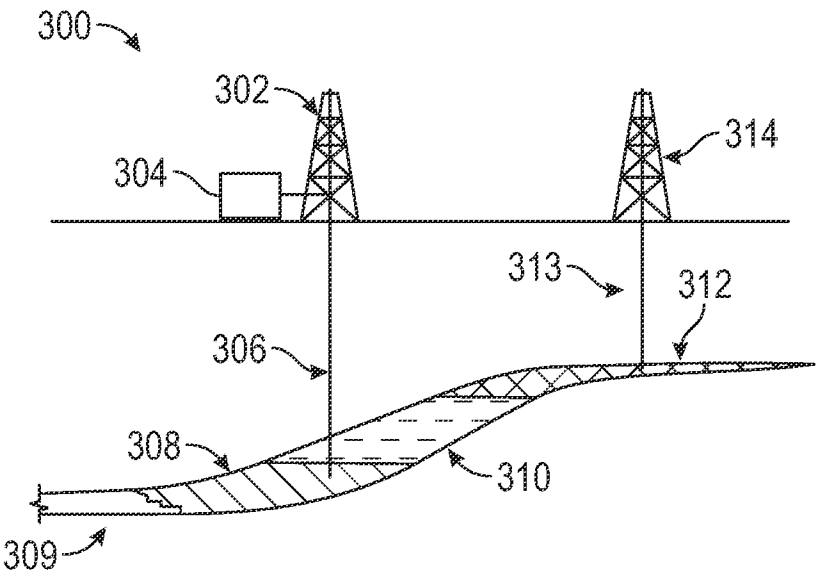
FIG. 3 is a schematic of a stratigraphic trap with an injection formation and a hydrocarbon bearing formation in accordance with one or more embodiments.
Figure 4:
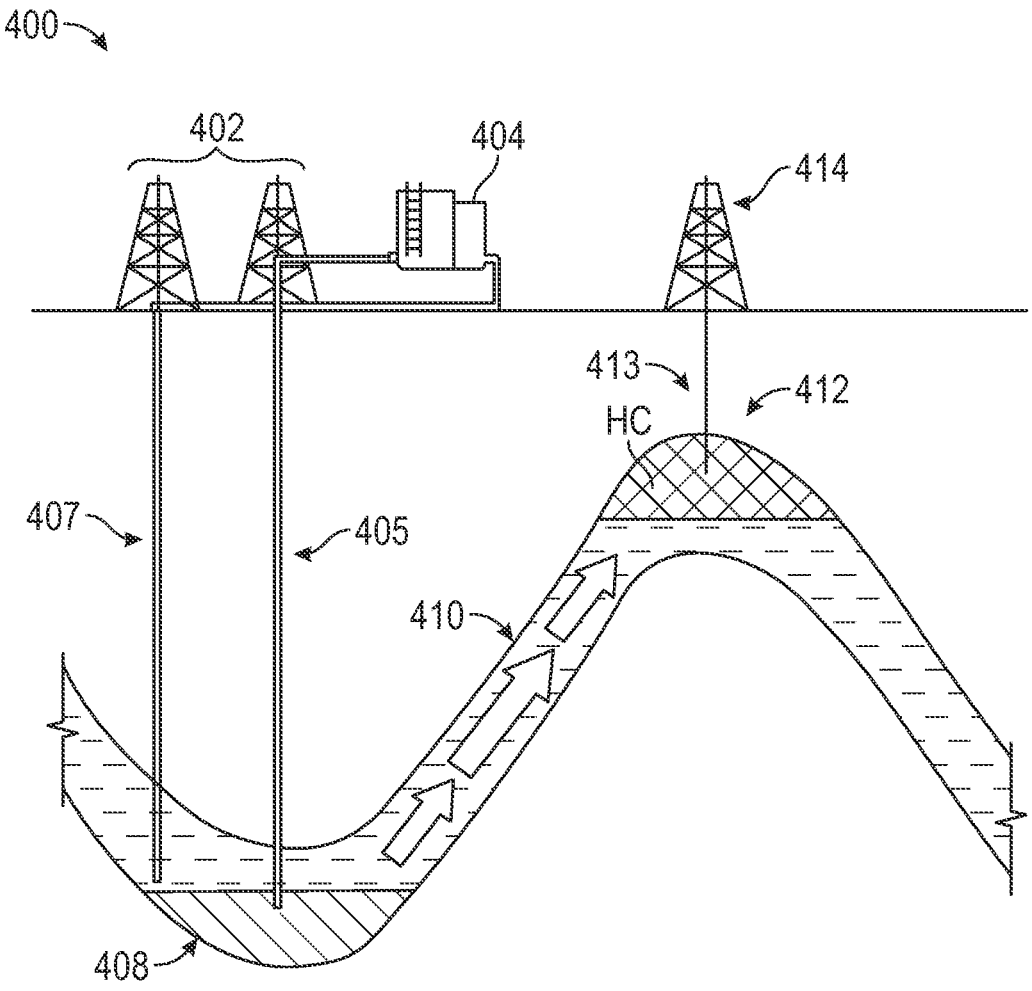
FIG. 4 is a schematic of a syncline-anticline trap configuration that includes a dual-mode well of the injection formation in accordance with one or more embodiments.

FIG. 3 is a schematic of a stratigraphic trap 300 with an injection formation 302 with an injection system 304 and hydrocarbon bearing formation 314. This configuration pinches out at the structural high 312 paired with an aquifer with a structural low 308 marked by a lateral lithology change from permeable sandstone 310 to impermeable shale 309. In such configurations, an injection well 306 and a producing well 313 may be independently disposed in the injection formation and hydrocarbon bearing formation, respectively.

In one or more embodiments, an injection well is disposed with an injection point proximate to the structural low and a producing well disposed with a receiving end proximate to the structural high. In one or more embodiments, a dual-mode well is disposed with a brine producing well and an injection point proximate to the structural low. FIG. 4 includes a non-limiting configuration 400 that includes a dual-mode well 402 of the injection formation and a hydrocarbon bearing formation 414 with a producing well 413 from a structural high 412. In one or more embodiments, a dual-mode well 402 is configured in the injection formation. The structural high 412 may be in fluid communication with the structural low 408 via hydraulic communication 410.

The brine producing well 407 of the dual-mode well 402 may produce a native formation fluid, such as a native brine, from the injection formation. In one or more embodiments, the brine producing well 407 is in fluid communication with an injection system 404 at the surface of the injection formation. In one or more embodiments, the native brine is used as a base fluid to dissolve $CO_2$.

In one or more embodiments, the injection system 404 is in fluid communication with the injection well 405 of the dual-mode well 402. In one or more embodiments, the injection system 404 is configured to dissolve $CO_2$ in the native brine produced from the brine producing well 407 to produce a dense $CO_2$-brine solution. In one or more embodiments, in which the dense $CO_2$-brine solution is prepared from a produced native formation fluid, a voidage replacement ratio of the $CO_2$-brine solution injected into the injection site balances a required pressure balance for the injection formation.

In one or more embodiments, a portion of the produced native formation fluid is directed away from the injection system. In one or more embodiments, the portion of the produced native formation fluid may be processed and converted to a freshwater source. The remaining portion of the produced native formation fluid may be directed to the injection system and processed to form the dense $CO_2$-brine solution as described above.

One or more embodiments includes stacked injection site hydrocarbon bearing formation pairs in fluid communication, such as via a hydraulic connection. In one or more embodiments, the hydraulic connection of the stacked injection formation and hydrocarbon bearing formation pair is between a structural low of the injection formation and a structural high of the hydrocarbon bearing formation.

As mentioned above, a dense $CO_2$-brine solution may be produced at a surface location of the injection formation, a surface location of the hydrocarbon bearing formation, or both. In one or more embodiments, an injection system is customized for a range of injection site and/or formation conditions such that the buoyancy of $CO_2$ is eliminated.

The injection system of one or more embodiments may enable methods to dissolve $CO_2$, such that the injection system provides a storing mechanism of $CO_2$. In one or more particular embodiments, the storing mechanism of $CO_2$ may include enabling a mineral carbonation storing mechanism of $CO_2$. In one or more embodiments, to $CO_2$ may be stored as one or more carbonate materials in an aqueous fluid, such as a brine, to form a dense $CO_2$-brine solution. The process of storing $CO_2$ as carbonate materials to form a $CO_2$-brine solution may increase the density of the aqueous fluid. In one or more embodiments, the increased density of the $CO_2$-brine solution is greater than the density of a native formation fluid of an injection site. In embodiments in which the density of the $CO_2$-brine solution is less than or equal to the density of the native formation fluid of an injection site, additives are included in the $CO_2$-brine solution to form a dense $CO_2$-brine solution, thereby increasing the density of the $CO_2$-brine solution to a density above the native formation fluid.

A dense $CO_2$-brine solution with a density above a threshold value may be formulated at a surface location of an injection formation. The threshold value of the density may be a value higher than the density of a native formation fluid. In one or more embodiments, a difference between the target density and the density of the native formation fluid exceeds a measurement error of a density measurement.

As mentioned above, a dense $CO_2$-brine solution may be prepared at a surface location of the injection formation. In one or more embodiments, the surface location includes an injection system and a base fluid. In one or more embodiments, a computer of the injection system derives a solubility value of $CO_2$ in a base fluid as a function of a base fluid salinity, a formation pressure, a formation temperature, or combinations thereof to ensure a dense $CO_2$-brine solution is formed. The base fluid salinity may be a native brine salinity, a produced brine salinity, a synthetic brine salinity, or combinations thereof. The formation pressure and formation temperature may be the injection site formation pressure and formation temperature.

In one or more embodiments, an injection system includes components, such as a mixing unit, a $CO_2$ injection line, a $CO_2$ sparger, an aqueous fluid injection line, and a dense $CO_2$-brine injection line. Such components of the injection system may be connected with associated fittings as known by those skilled in the art. The injection system of one or more embodiments provides the dense $CO_2$-brine solution via injection of a volume of $CO_2$ to a volume of a base fluid in a mixing unit.

In one or more embodiments, a ratio of the volume of $CO_2$ to the volume of the base fluid is a ratio that provides a density of the dense $CO_2$-brine solution over a threshold density value. In one or more embodiments, the $CO_2$ injection line and the aqueous fluid injection line are independently in fluid communication with the mixing unit. The mixing unit may be in fluid communication with the dense $CO_2$-brine injection line. The dense $CO_2$-brine injection line may be in fluid communication with the injection site via an injection tubing inserted into the injection well. The injection tubing may be any tubing known to those skilled in the art to inject fluids in a formation.

In one or more embodiments, the preparation of the dense $CO_2$-brine solution includes selecting a base fluid to dissolve $CO_2$. The base fluid may be an aqueous fluid, such as water.

The water may be distilled water, brine, deionized water, tap water, fresh water from surface or subsurface sources, formation water produced from the structural low, formation water produced from a different geologic formation, production water, frac or flowback water, natural and synthetic brines, residual brine from desalination processing, a regional water source, such as fresh water, brackish water, natural and synthetic sea water, potable water, non-potable water, other waters, and combinations thereof, that are suitable for use in a wellbore environment. In one or more embodiments, the water used may naturally contain contaminants, such as salts, ions, minerals, organics, and combinations thereof, as long as the contaminants do not interfere with the density of a dense $CO_2$-brine solution. In one or more embodiments, the aqueous fluid includes additives such as viscosifiers, polymers, surfactants, and combinations thereof.

As mentioned above, an injection system may mix a volume of $CO_2$ with a volume of an aqueous fluid. In one or more embodiments, the injection system providing the $CO_2$-brine solution as described above may include additional modules, sensors, and/or systems as known by one skilled in the art. For example, the injection system may include a fluid property sensor. The fluid property sensor may transmit a $CO_2$-brine solution property, such as density, pH, rheology, volume, weight, flow, among other properties, to a user device. The user device may include a desired predetermined density value, which may include a range of acceptable values, a threshold value that should be exceeded, a precise scalar quantity, etc. As such, a solution mixing manager or another control system may receive sensor data from various $CO_2$-brine solution sensors regarding various $CO_2$-brine solution property parameters as mentioned above. In addition, sensor data may refer to both raw sensor measurements and/or processed sensor data associated with one or more $CO_2$-brine solution properties.

In one or more embodiments, an injection system includes a $CO_2$-brine solution property system to control the supply of various additives to a mixing tank. The $CO_2$-brine solution property system may be automated or be under manual control. For example, a $CO_2$-brine solution property system may include hardware and/or software with functionality for supplying and/or mixing additives, such as weighting agents, buffering agents, rheological modifiers, and/or other additives, until a dense $CO_2$-brine solution matches and/or satisfies one or more desired solution properties. In one or more embodiments, the hardware and/or software is configured to automatically supply and/or mix additives.

Non-limiting examples of weighting agents may include barite, hematite, calcium carbonate, siderite, gels, fines, or combinations thereof. A buffering agent may be a pH buffering agent that causes a dense $CO_2$-brine solution to resist changes in pH levels. For example, a buffering agent may include water, a weak acid (or weak base) and salt of the weak acid (or a salt of weak base). Non-limiting examples of rheological modifiers may include drilling fluid additives that adjust one or more flow properties of a $CO_2$-brine solution. One type of rheological modifier is a viscosifier, which may be an additive with functionality for providing thermal stability, hole-cleaning, shear-thinning, improving carrying capacity as well as modifying other attributes of a dense $CO_2$-brine solution. Non-limiting examples of viscosifiers include bentonite, inorganic viscosifiers, polymeric viscosifiers, low-temperature viscosifiers, high-temperature viscosifiers, oil-fluid liquid viscosifiers, organophilic clay viscosifiers, and biopolymer viscosifiers.

In one or more embodiments, an injection system includes a material transfer system. A material transfer system may include a control system with functionality for managing supplies of bulk powder and other inputs for producing a dense $CO_2$-brine solution. For example, a material transfer system may include a pneumatic, conveyer belt or a screw-type transfer system (e.g., using a screw pump) that transports material, such as a weighting material, from a supply tank upon a command from a sensor-mediated response. Thus, the material transfer system may monitor a mixing tank using weight sensors and/or volume sensors to meter a predetermined amount of bulk powder to a selected mixing tank. In one or more particular embodiments, the material transfer system of one or more embodiments may be automated or under manual control at a surface location of the injection site.

In one or more embodiments, standard injectivity measurements are obtained prior to the injection of the dense $CO_2$-brine solution, while injecting the dense $CO_2$-brine solution, after injecting the dense $CO_2$-brine solution, or combinations thereof. Standard injectivity measurements may include fluid compatibility tests and critical velocity tests. Fluid compatibility tests include injection of a candidate brine sample, such as a dense $CO_2$-brine solution, through a core sample followed by measuring the pressure drop across the sample to obtain the sample permeability, which reflects injectivity. The injection test may be performed with an additional injection volume to observe any decrease in permeability due to interaction between the injected candidate brine sample and the core sample.

In a critical velocity test, a candidate brine sample may be injected in a core sample at a candidate brine sample injection rate that is gradually increased until permeability reduction occurs. As one of ordinary skill may appreciate, such tests provide guidance for a candidate brine compatibility, such as a dense $CO_2$-brine solution compatibility, as well as limits on injection rates for the injection formation. Such measurements may be obtained using injection formation core samples, hydrocarbon bearing formation core samples, or both to optimize injection rates.

In one or more embodiments, selecting the injection formation and the hydrocarbon bearing formation and/or injecting the dense $CO_2$-brine solution includes simulating, by a computer, the selected injection formation and hydrocarbon bearing formation. In one or more embodiments, an optimum dense $CO_2$-brine solution injection rate is quantified. In one or more embodiments, a computer at a surface location of the injection formation simulates conditions of an injection formation, a hydrocarbon bearing formation, the hydraulic connection of the injection formation and the hydrocarbon bearing formation, or combinations thereof. The computer may simulate formation conditions before, during, or after injecting the dense $CO_2$-brine solution into an injection site. The computing device simulated formation conditions of one or more embodiments are based on established multi-phase implementations of fluid flow in a porous medium.

In one or more embodiments, a computing device analyzes the seismic interpretation, the well log analysis, the production history, or combinations thereof as mentioned above. In one or more embodiments, a computing device obtains seismic data regarding a geological region of interest. The computing device may deconvolute the obtained seismic data, well-log data, production data, regarding the geological region of interest. The computing device may then transmit data related to the geologic region comprising the injection formation hydraulically connected to a hydrocarbon bearing formation. The computing device of one or more embodiments is as described below.

Figure 5:
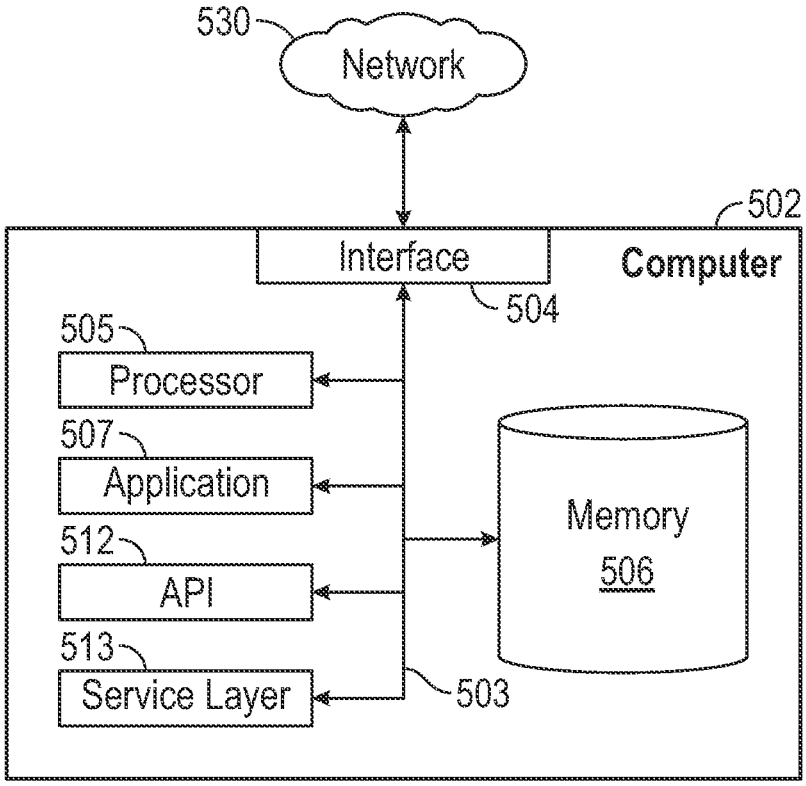
FIG. 5 is a computing system in accordance with one or more embodiments.

FIG. 5 further depicts a block diagram of a computer system (502) used to provide computational functionalities associated with described algorithms, methods, functions, processes, flows, and procedures as described in this disclosure, according to one or more embodiments. The illustrated computer (502) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (502) may include a computer that includes an input device, such as a keypad, keyboard, touch screen, or other device that can accept user information, and an output device that conveys information associated with the operation of the computer (502), including digital data, visual, or audio information (or a combination of information), or a GUI.

The computer (502) can serve in a role as a client, network component, a server, a database or other persistency, or any other component (or a combination of roles) of a computer system for performing the subject matter described in the instant disclosure. The illustrated computer (502) is communicably coupled with a network (530). In some implementations, one or more components of the computer (502) may be configured to operate within environments, including cloud-computing-based, local, global, or other environment (or a combination of environments).

At a high level, the computer (502) is an electronic computing device operable to receive, transmit, process, store, or manage data and information associated with the described subject matter. According to some implementations, the computer (502) may also include or be communicably coupled with an application server, e-mail server, web server, caching server, streaming data server, business intelligence (BI) server, or other server (or a combination of servers).

The computer (502) can receive requests over network (530) from a client application (for example, executing on another computer (502) and responding to the received requests by processing the said requests in an appropriate software application. In addition, requests may also be sent to the computer (502) from internal users (for example, from a command console or by other appropriate access method), external or third-parties, other automated applications, as well as any other appropriate entities, individuals, systems, or computers.

Each of the components of the computer (502) can communicate using a system bus (503). In some implementations, any or all of the components of the computer (502), both hardware or software (or a combination of hardware and software), may interface with each other or the interface (504) (or a combination of both) over the system bus (503) using an application programming interface (API) (512) or a service layer (513) (or a combination of the API (512) and service layer (513). The API (512) may include specifications for routines, data structures, and object classes. The API (512) may be either computer-language independent or dependent and refer to a complete interface, a single function, or even a set of APIs. The service layer (513) provides software services to the computer (502) or other components (whether or not illustrated) that are communicably coupled to the computer (502). The functionality of the computer (502) may be accessible for all service consumers using this service layer. Software services, such as those provided by the service layer (513), provide reusable, defined business functionalities through a defined interface. For example, the interface may be software written in JAVA, C++, or other suitable language providing data in extensible markup language (XML) format or another suitable format. While illustrated as an integrated component of the computer (502), alternative implementations may illustrate the API (512) or the service layer (513) as stand-alone components in relation to other components of the computer (502) or other components (whether or not illustrated) that are communicably coupled to the computer (502). Moreover, any or all parts of the API (512) or the service layer (513) may be implemented as child or sub-modules of another software module, enterprise application, or hardware module without departing from the scope of this disclosure.

The computer (502) includes an interface (504). Although illustrated as a single interface (504) in FIG. 5, two or more interfaces (504) may be used according to particular needs, desires, or particular implementations of the computer (502). The interface (504) is used by the computer (502) for communicating with other systems in a distributed environment that are connected to the network (530). Generally, the interface (504) includes logic encoded in software or hardware (or a combination of software and hardware) and operable to communicate with the network (530). More specifically, the interface (504) may include software supporting one or more communication protocols associated with communications such that the network (530) or interface's hardware is operable to communicate physical signals within and outside of the illustrated computer (602).

The computer (502) includes at least one computer system (505). Although illustrated as a single computer system (505) in FIG. 5, two or more processors may be used according to particular needs, desires, or particular implementations of the computer (502). Generally, the computer system (505) executes instructions and manipulates data to perform the operations of the computer (502) and any algorithms, methods, functions, processes, flows, and procedures as described in the instant disclosure.

The computer (502) also includes a memory (506) that holds data for the computer (502) or other components (or a combination of both) that can be connected to the network (530). For example, memory (506) can be a database storing data consistent with this disclosure. Although illustrated as a single memory (506) in FIG. 5, two or more memories may be used according to particular needs, desires, or particular implementations of the computer (502) and the described functionality. While memory (506) is illustrated as an integral component of the computer (502), in alternative implementations, memory (506) can be external to the computer (502).

The application (507) is an algorithmic software engine providing functionality according to particular needs, desires, or particular implementations of the computer (502), particularly with respect to functionality described in this disclosure. For example, application (507) can serve as one or more components, modules, applications, etc. Further, although illustrated as a single application (507), the application (507) may be implemented as multiple applications (507) on the computer (502). In addition, although illustrated as integral to the computer (502), in alternative implementations, the application (507) can be external to the computer (502).

There may be any number of computers (502) associated with, or external to, a computer system containing computer (502), wherein each computer (502) communicates over network (530). Further, the term "client," "user," and other appropriate terminology may be used interchangeably as appropriate without departing from the scope of this disclosure. Moreover, this disclosure contemplates that many users may use one computer (602), or that one user may use multiple computers (502).

In one or more embodiments, the computing device simulates formation conditions using a suitable compute code. Non-limited examples of formation simulation code include research-based formation simulation code, such as TOUGH2 available from by Lawrence Berkley National Laboratory and commercial formation simulation code, such as Eclipse® available from Schlumberger Software or GEM available from CMG Computer Modelling Group Software, LLC., among others. The computer deriving simulated information of one or more embodiments optimizes the injecting of the dense $CO_2$-brine solution. In one or more embodiments, the optimization includes determining an injection well location, an injection pressure of the dense $CO_2$-brine solution, an injection rate of the dense $CO_2$-brine solution, or combinations thereof. In one or more particular embodiments, the optimization provides a volumetrically maximized amount of $CO_2$ sequestration, as well as hydrocarbon recovery. Maximized hydrocarbon recovery may relate to hydrocarbons recovered from a hydrocarbon bearing formation in fluid communication with the injection formation.

In one or more embodiments, injection of the dense $CO_2$-brine into an injection point, such as proximate to a structural low of an aquifer, increases a formation pressure of the injection formation, the hydraulic connection, or both. In one or more particular embodiments, the injection of the dense $CO_2$-brine solution includes injecting an additional volume into a fixed volume of the injection site. In one or more embodiments, the native formation fluid from the injection formation is displaced upon the injection of the dense $CO_2$-brine solution. In one or more embodiments, a fluid drive pressure from the injection well to the producing well via the hydraulic connection increases.

In one or more embodiments, the pressure buildup increases a fluid drive pressure, such as a water drive pressure, from a structural low of the injection site via hydraulic connection to a structural high of a hydrocarbon bearing formation. In one or more embodiments, the increased drive pressure may enhance or increase a drive mechanism of the hydrocarbon bearing formation. The drive mechanisms of the hydrocarbon bearing formation of one or more embodiments includes a solution gas drive, a gas cap drive, a water drive, or combinations thereof. Thus, the increased fluid drive pressure may enhance or increase hydrocarbon recovery from the hydrocarbon bearing formation.

For example, an injection well injecting the dense $CO_2$-brine solution from a surface location of the injection site may fill the structural low of the injection site with the dense $CO_2$-brine solution. As the dense $CO_2$-brine solution is formulated to be denser than a density of a native formation water, the $CO_2$ of the dense $CO_2$-brine solution may not escape from the structural low, thereby accumulating the dense $CO_2$-brine solution at the bottom of the structural low. The accumulation of the dense $CO_2$-brine solution may compress the native formation water such that the native formation water is displaced from the pore space of the injection site. The displaced native formation water may then flow toward the structural high via the hydraulic connection to the structural high. Thus, the water drive pressure of a hydrocarbon accumulation of the structural high may be increased.

Embodiments of the present disclosure provide at least one of the following advantages. One or more embodiments provide an optimized volumetric amount of $CO_2$ sequestration and simultaneously provide enhanced hydrocarbon production. The storage mechanism of $CO_2$ may provide a permanent sequestration method via mineral carbonation and solubilization in a base fluid to form a dense $CO_2$-brine solution. As such, the dense $CO_2$-brine solution may accumulate in the structural low with minimal to no $CO_2$ leakage. In addition, using produced water as a base fluid from an injection location to dissolve $CO_2$ may provide a sufficient volume of a base fluid to alleviate aqueous fluid needs in areas for which potable water may be scarce.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A method for both enhancing oil recovery of a reservoir and sequestering $CO_2$, the method comprising:

dissolving $CO_2$ in a base fluid at a surface location of an injection formation to increase the density of the base fluid and form a dense $CO_2$-brine solution, wherein the base fluid is a residual brine from desalination processing, a sea water, a fresh water, synthetic brine, a produced brine, or combinations thereof, wherein:

the dense $CO_2$-brine solution has a density greater than a native formation fluid of the injection formation, and the injection formation is a same geologic formation or a different geologic formation from a hydrocarbon bearing formation, wherein the injection formation comprises a structural low and the hydrocarbon bearing formation comprises a structural high, wherein the structural low is in fluid communication with the structural high via a hydraulic connection;

introducing the dense $CO_2$-brine solution into an injection well having an injection point proximate to the structural low, thereby accumulating a volume of the dense $CO_2$-brine solution in the structural low;

displacing the native formation fluid from the injection well to a producing well having a receiving end proximate to the structural high via the hydraulic connection to form a displaced native formation fluid, thereby increasing a fluid drive pressure of the hydraulic connection; and displacing hydrocarbons of the producing well with the displaced native formation fluid via the fluid drive pressure of the hydraulic connection.

2. The method of claim 1, wherein identifying the injection formation hydraulically connected to a hydrocarbon bearing formation further comprises:

obtaining, by a computer system, seismic data regarding a geological region of interest;

deconvoluting, by a computer system, the seismic data, well-log data, production data, regarding the geologic region of interest; and transmitting, by the computer system, the geologic region of interest comprising the injection formation hydraulically connected to a hydrocarbon-bearing formation.

3. The method of claim 1, further comprising:

measuring a density of the native formation fluid of the injection formation measuring $CO_2$ solubility in the base fluid as a function of a salinity of the base fluid, pressure, temperature, or combinations thereof.

4. The method of claim 3, wherein the produced brine comprises an aqueous fluid selected from the group consisting of a formation water, a frac or flowback water, and combinations thereof.

5. The method of claim 1, dissolving $CO_2$ in a base fluid at a surface location of the injection formation further comprises providing an injection system at the surface location of the injection system.

6. The method of claim 5, further comprising storing $CO_2$ via a $CO_2$ storage mechanism in the base fluid.

7. The method of claim 1, wherein the injection formation hydraulically connected to the hydrocarbon-bearing formation is a syncline or an anticline.

8. The method of claim 1, wherein the injection formation and the hydrocarbon bearing formation is an aquifer-reservoir pair.

9. The method of claim 1, further comprising:

deriving an optimal dense $CO_2$ fluid injection rate prior to introducing the dense $CO_2$-brine solution into the formation.

10. The method of claim 1, further comprising producing a formation brine via a production well from the injection formation or via a hydrocarbon production well.

11. The method of claim 9, further comprising:

transporting the base fluid to an injection system in fluid communication with the injection well of the injection formation; and dissolving $CO_2$ in the base fluid in the injection system, wherein the base fluid comprises a formation brine.

12. A system for both enhancing oil recovery of a reservoir and sequestering $CO_2$, the system comprising:

an injection system in fluid communication with an injection well having an injection point proximate to a structural low in an injection formation in fluid communication with a hydrocarbon production formation via a hydraulic connection, wherein a production well is disposed with a receiving end proximate to a structural high of the hydrocarbon production formation, wherein the injection formation and the hydrocarbon production formation are a same geologic formation or different geologic formations; and a dense $CO_2$-brine solution having a density greater than a native formation fluid present in the injection formation, wherein the dense $CO_2$-brine solution comprises an amount of $CO_2$ dissolved in a base fluid, and wherein the base fluid is a residual brine from desalination processing, a sea water, a fresh water, a synthetic brine, a produced brine, or combinations thereof, and wherein the dense $CO_2$-brine solution is configured to accumulate in the structural low of the injection well, and wherein the injection system is configured to inject the dense $CO_2$-brine solution into the injection well.

13. The system of claim 12, wherein the injection formation and the hydrocarbon bearing formation is an aquifer-reservoir pair.

14. The system of claim 12, wherein the production well, an optional production line in the injection formation, or both produces a native formation fluid.

15. The system of claim 12, wherein the produced brine is selected from the group consisting of a formation water, a frac or flowback water, and combinations thereof.

16. The system of claim 12, wherein the dense $CO_2$-brine solution further comprises one or more additives selected from the group consisting of weighting agents, viscosifiers, polymers, surfactants, and combinations thereof.

17. The system of claim 16, wherein the one or more weighting agents are selected from the group consisting of barite, hematite, calcium carbonate, siderite, gels, fines, and combinations thereof.

18. The system of claim 12, wherein the injection formation and the hydrocarbon production formation is an aquifer-reservoir pair.

* * * * *